United States Patent [19]

Bouck

[11] 4,412,585

[45] Nov. 1, 1983

[54] ELECTROTHERMAL PROCESS FOR RECOVERING HYDROCARBONS

[75] Inventor: Larry S. Bouck, Tulsa, Okla.

[73] Assignee: Cities Service Company, Tulsa, Okla.

[21] Appl. No.: 374,582

[22] Filed: May 3, 1982

[51] Int. Cl.[3] ..... E21B 36/04; E21B 43/24

[52] U.S. Cl. ..... 166/248; 166/60; 166/272; 166/302

[58] Field of Search ..... 166/248, 272, 288, 302, 166/57, 58, 59, 60, 65 R

[56] References Cited

U.S. PATENT DOCUMENTS

| | | | |
|---|---|---|---|
| 2,795,279 | 6/1957 | Sarapuu | 166/248 |
| 2,889,882 | 6/1959 | Schleicher | 166/248 |
| 3,104,705 | 9/1963 | Ortloff et al. | 166/60 X |
| 3,106,244 | 10/1963 | Parker | 166/248 |
| 3,137,347 | 6/1964 | Parker | 166/60 X |
| 3,236,304 | 2/1966 | Sarapuu | 166/60 X |
| 3,698,478 | 10/1972 | Parker | 166/248 |
| 3,848,671 | 11/1974 | Kern | 166/248 |
| 4,084,637 | 4/1978 | Todd | 166/248 X |
| 4,085,798 | 4/1978 | Schweitzer | 166/248 X |
| 4,228,854 | 10/1980 | Sacuta | 166/248 |

*Primary Examiner*—Stephen J. Novosad
*Assistant Examiner*—George A. Suchfield
*Attorney, Agent, or Firm*—George L. Rushton

[57] ABSTRACT

In a pair of electrode wells to be developed for injection and production wells for the electrothermal process for recovering heavy hydrocarbons, the electrodes are formed by inserting a heating device in each borehole and heating the surrounding formation to a temperature at which the hydrocarbon-containing material undergoes thermal cracking, resulting in a coke-like residue surrounding the heater. This conductive and permeable material serves as an electrode, for each well, by which the formation is heated. The heavy hydrocarbon material, such as bitumen found in tar sands, becomes mobile and can be recovered.

2 Claims, 6 Drawing Figures

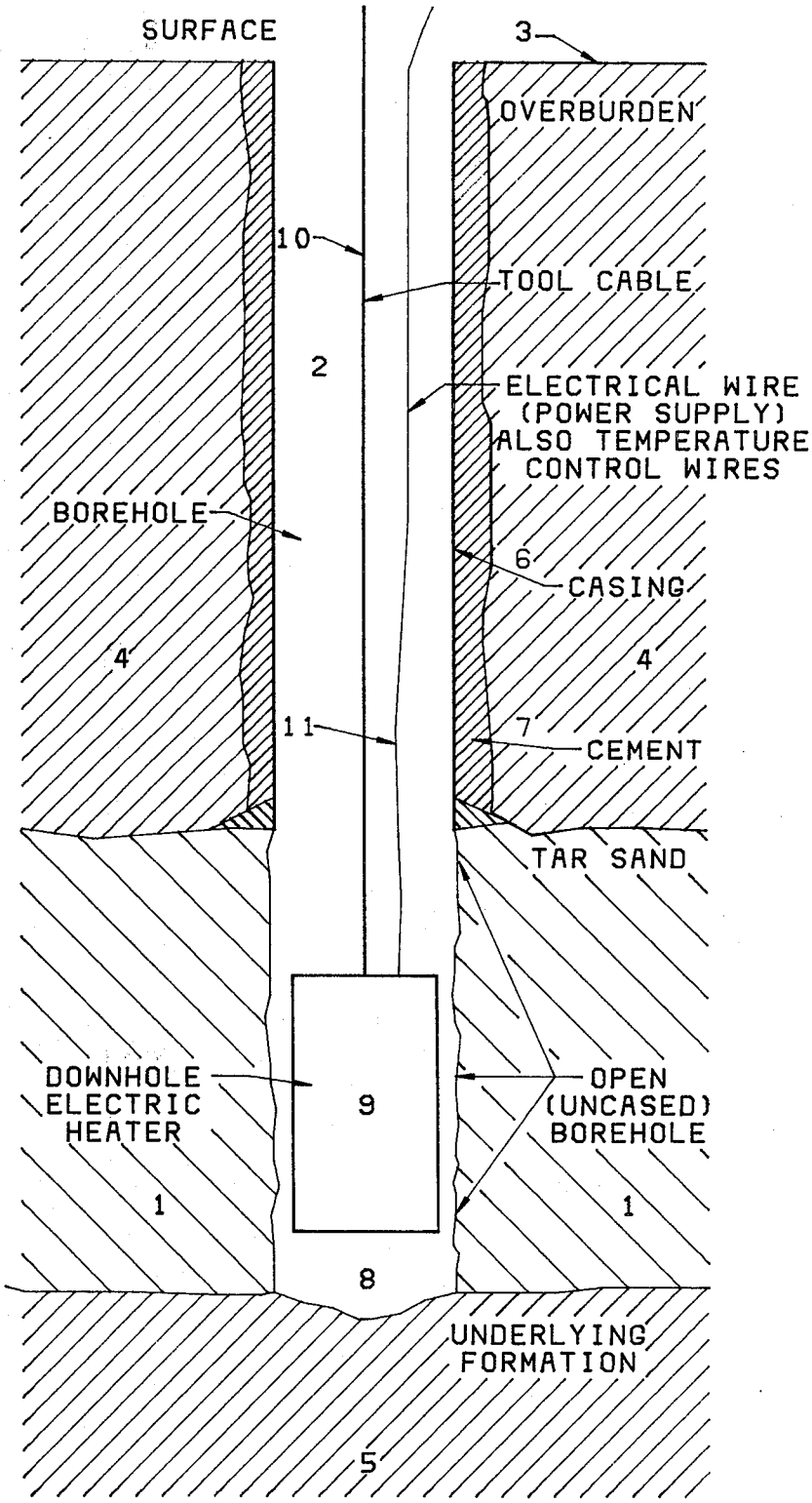
FIG. I
CROSS SECTION OF BOREHOLE AT THE INITIATION OF THE COKING PROCESS

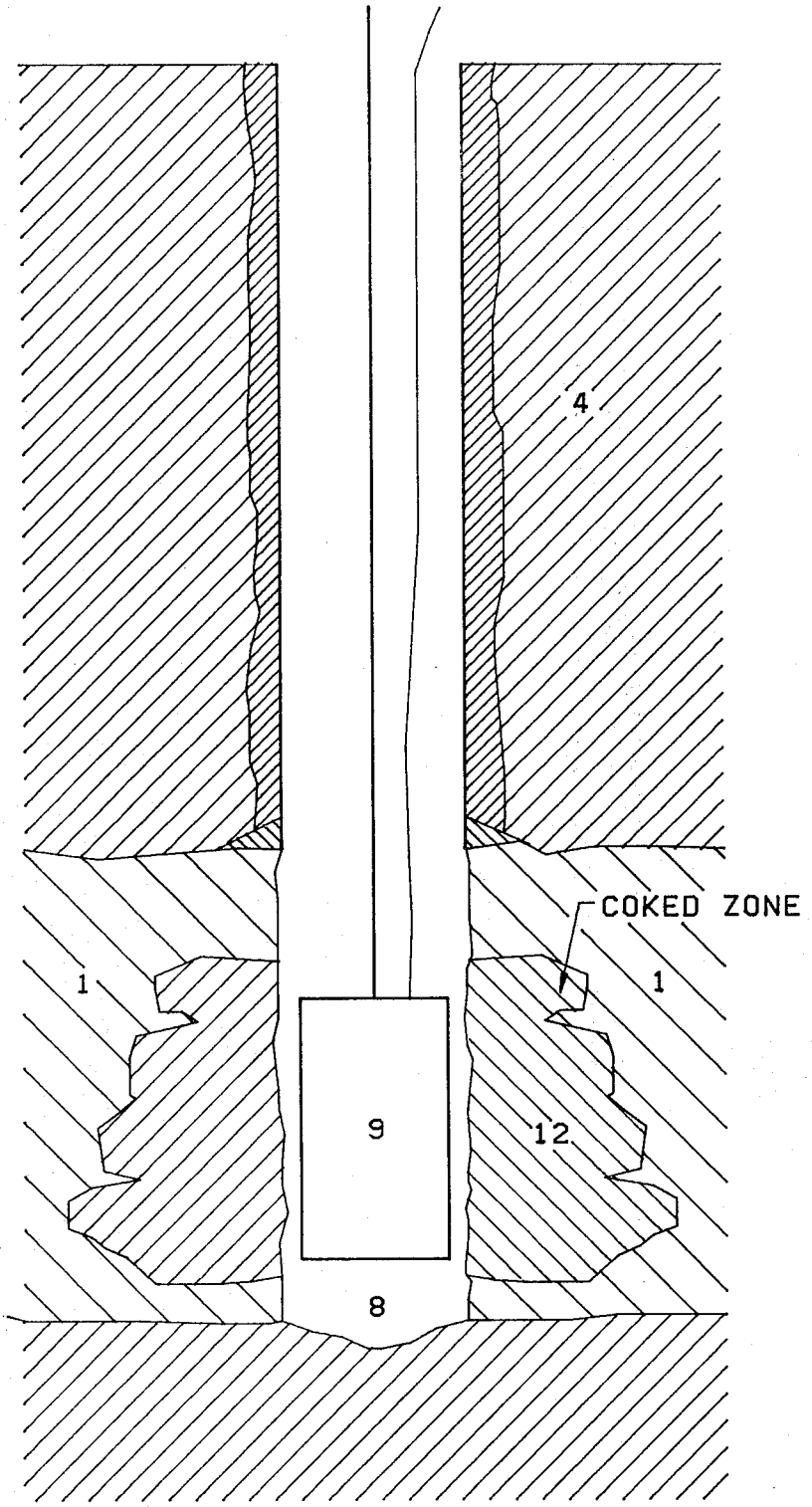
FIG. II
AT THE END OF THE COKE-PRODUCING PROCESS

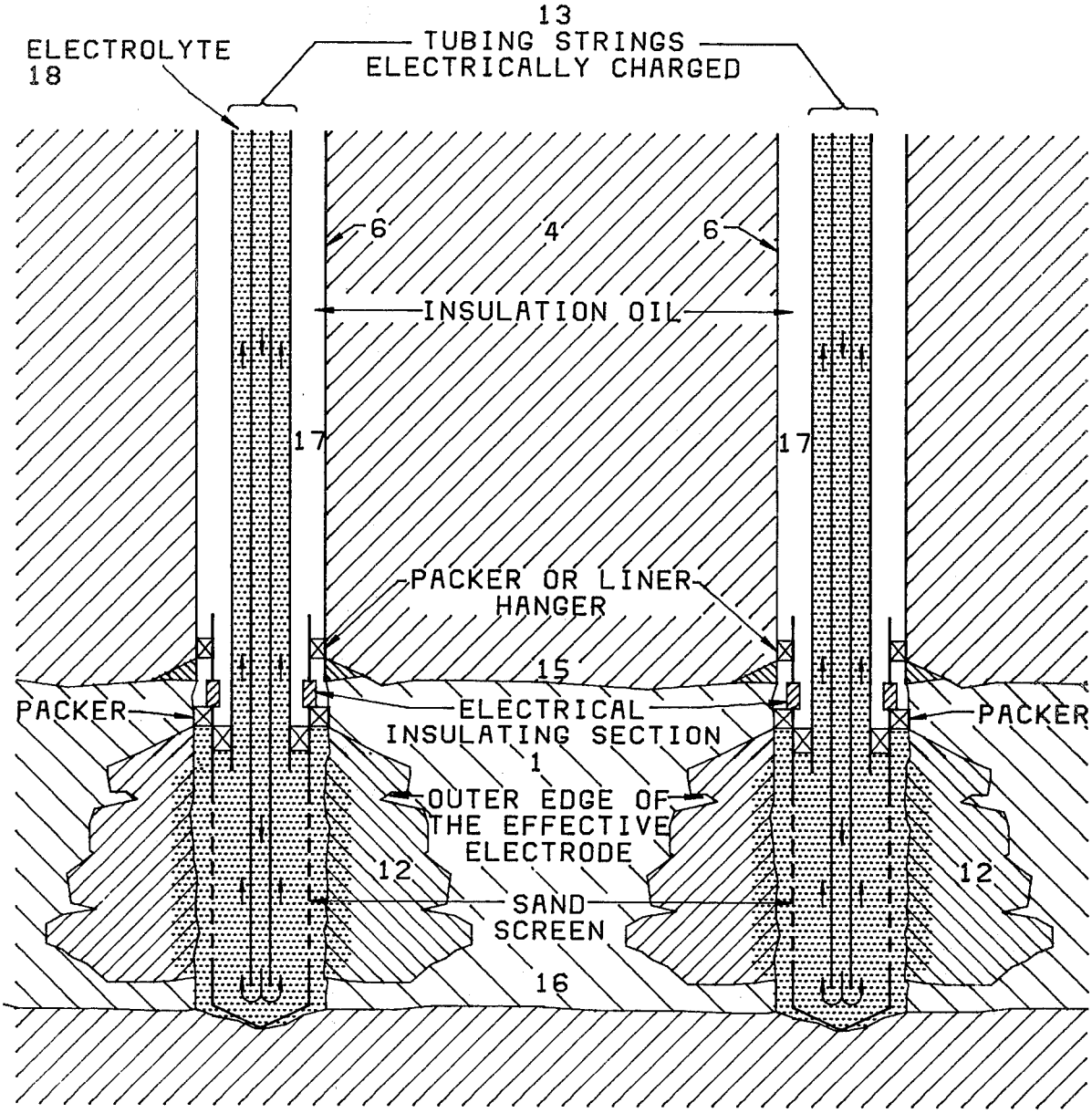
FIG. III
ELECTRODE WELLS WITH ELECTRODES OF
ENLARGED EFFECTIVE RADIUS

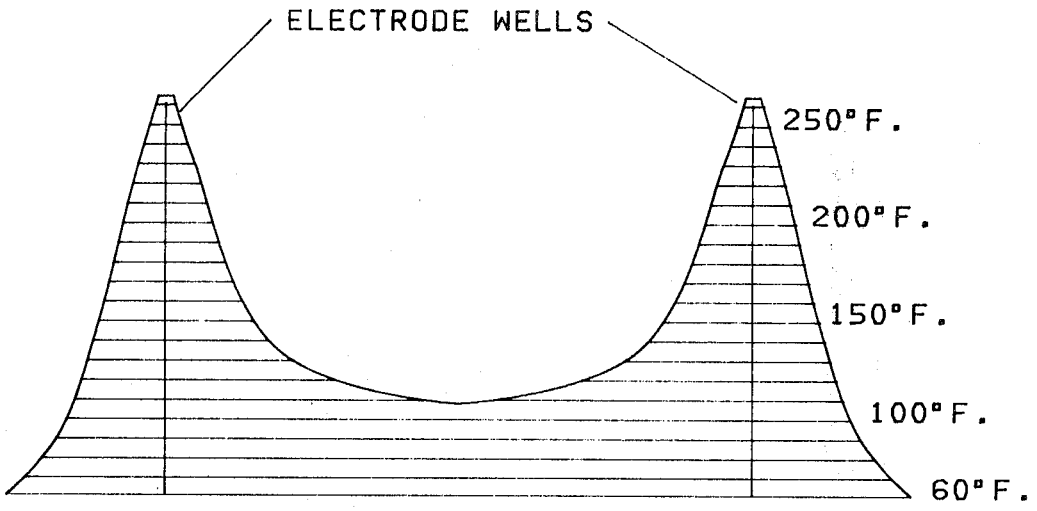
FIG. IV-a
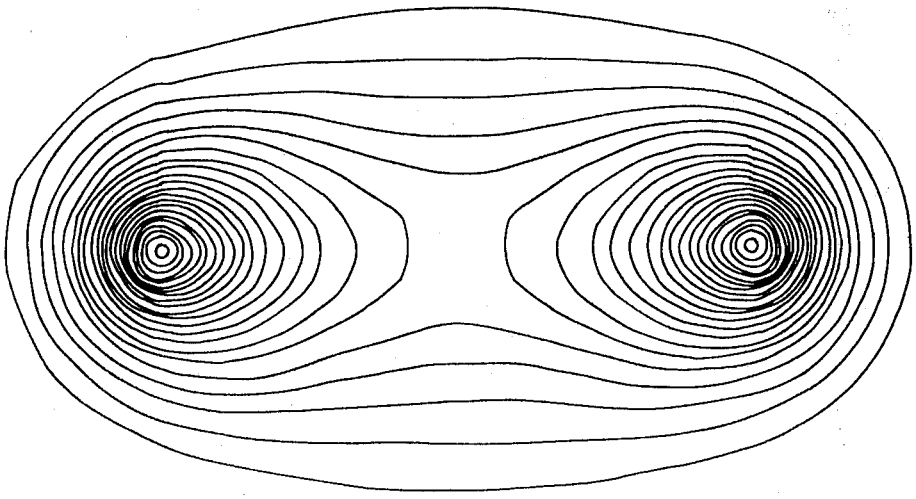
FIG. IV-b

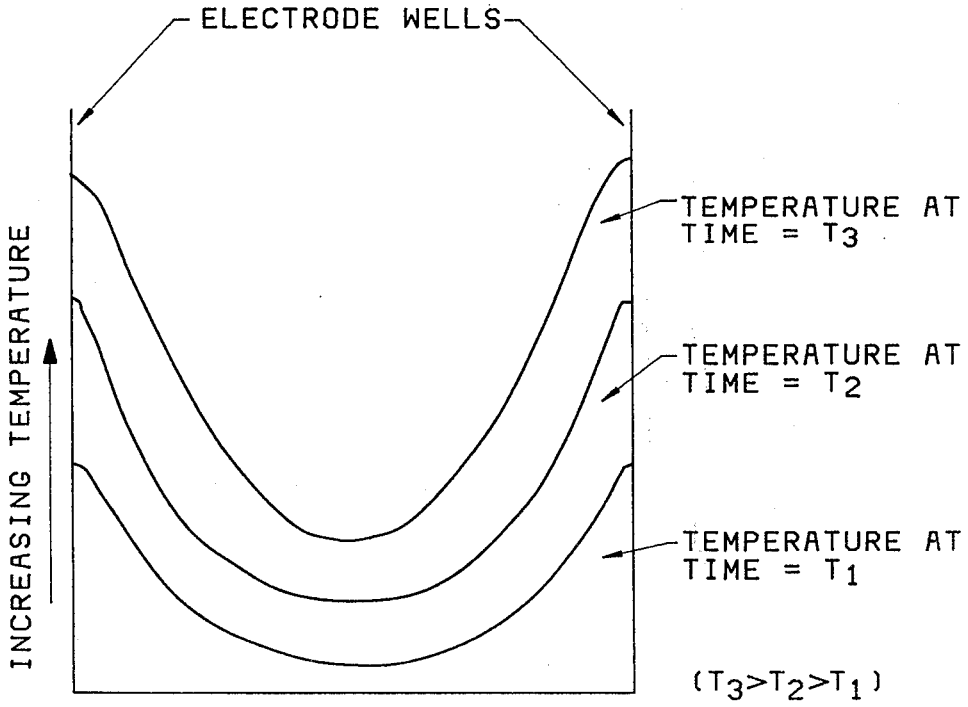
FIG. V

ELECTROTHERMAL PROCESS FOR RECOVERING HYDROCARBONS

BACKGROUND OF THE INVENTION

This invention relates to a process for recovering hydrocarbon values from an underground hydrocarbon-bearing formation. More particularly, the invention relates to a process for recovering these hydrocarbons by electrothermal means, wherein the subterranean formation is heated, thus making the hydrocarbon values mobile and recoverable. A broad statement of the complete process includes these steps:

(a) the formation of underground electrodes of enlarged radius, (b) using the formed electrodes to heat the formation between wells, thus making the hydrocarbon material (bitumen) mobile, and (c) removal and recovery of the mobile material, such as by a displacing fluid.

The utility of the invention lies in the recovery of hydrocarbons from an underground formation.

Although a majority of petroleum is produced from freely-flowing wells drilled into a subterranean formation, there are many hydrocarbonaceous materials that cannot be produced directly in such a manner—some supplemental operation is required to recover such materials. Secondary and tertiary methods of recovering petroleum are wellknown, such as water-flooding or steam-flooding. If the hydrocarbon values in the underground formation are too viscous or are otherwise retained in the formation, one method of reducing the viscosity or liberating the hydrocarbon values is by the application of heat to the underground formation. Heat energy can be introduced to the underground formation by means of a heated liquid or gas or by the combustion of a portion of the underground hydrocarbon values. Another method of introducing heat energy is by the use of electrical energy in the subterranean formation, resulting in resistance heating.

However, there are problems in heating by electricity. If the temperature in the vicinity of the electrode wellbore is not kept below the vaporization temperature of connate water typically found in the subterranean formation, the removal of this connate water by vaporization effectively hinders the flow of current into the formation, thus limiting the amount of formation heating.

Since the prior art methods of heating a subterranean formation, and thus recovering hydrocarbon values, have not been totally satisfactory, I submit that my invention overcomes the difficulties encountered and offers an improved method of recovering hydrocarbon values from an underground hydrocarbon-bearing formation.

SUMMARY OF THE INVENTION

My invention concerns an electrothermal process for recovering hydrocarbon values from an underground hydrocarbon-bearing formation having at least two separated boreholes penetrating the hydrocarbon-bearing formation, comprising the steps of:

(a) placing a heating device in the first borehole, (b) energizing the device to heat the surrounding formation to a temperature high enough to produce coking of at least a portion of the hydrocarbon-bearing formation, thus forming a coked zone, which, having conductive properties, acts as an electrode, (c) maintaining the temperature of step (b) for a length of time to obtain a coked zone electrode having an effective radius at least twice that of the borehole, (d) repeating steps (a–c) in a second borehole, (e) applying an electromotive potential between the coked zone electrodes of the first and second boreholes, to heat the formation between the boreholes to a temperature at which the hydrocarbon values are mobile, and (f) recovering hydrocarbon values from one of said boreholes.

The essence of the invention lies in the formation of an electrode of enlarged effective radius. An electrode well is a well completed with appropriate electrical features so it can function as an electrode in contact with the adjacent formation. After such an electrode, and a companion one in another borehole, is formed, current can be sent from one electrode through the formation to the other electrode, thus heating the formation. By the use of the electrode of enlarged effective radius, the current density on the electrode is decreased, thus lessening the resistance heating near the electrode. In this manner, the temperature in the vicinity of the enlarged electrode does not become high enough to vaporize the connate water and thus formation heating can continue. By the proper application of electricity between the electrodes, heating of the intervening formation is enhanced, until the temperature between wells is sufficient to make the bitumen mobile. This mobile and liberated bitumen can then be displaced and removed. Mobility of a fluid in a porous media is considered to be proportional to the permeability of the porous medium and inversely proportional to the viscosity of that fluid. Increasing mobility increases the producibility of the given reservoir fluid. Thus, this invention increases the producibility of the hydrocarbon by lowering the viscosity and increasing the mobility through electrical heating.

The mid-point temperature of the formation between two electrode wells will generally be lower than the rest of the heated formation because of low current density at that point. It will also provide a good indicator of how much heating must occur, as it is at this point that the hydrocarbon will be least mobile. The actual mid-point temperature needed will depend on the viscosity-temperature relationship of the hydrocarbon and the nature of the displacing fluid. For Athabasca-type bitumen and using steam as a displacing fluid, this temperature would range from about 130° to about 230° F. (54° C.–110° C.).

DESCRIPTION OF THE DRAWINGS

FIG. 1 is a cross-section view of a borehole at the initiation of the coking process.

FIG. II shows a cross-section view of the borehole at the end of the coke-producing process.

FIG. III shows one embodiment of the invention, a cross-section view of two electrode wells, each having an enlarged effective radius.

FIG. IV-*a* shows, in cross section, the temperature profile between two electrode wells, at some time during the heating process.

FIG. IV-*b* shows, in cross section, a plan view of the temperature profile between the same electrode wells as in FIG. 4-*a*.

FIG. V shows a cross-section view of the temperature profile between two electrode wells after various heating times.

DETAILED DESCRIPTION OF THE INVENTION

Since the invention relates to a process for recovering hydrocarbon values from an underground hydrocarbon-bearing formation and since, more particularly, the process involves coking of the formation, underground formations that can be used in this invention are those exemplified by tar sand, oil shale, and heavy oil deposits, such as those found in Canada and in the Orinoco Basin. These formations contain material that can be transformed into coke or a coke-like material which is carbonaceous in substance and typically has a permeability greater than that of the original formation.

At least two boreholes are used in the process of the invention. The details and the technology of drilling and completing these boreholes is well known in the art and need not be discussed here. FIGS. I, II, and III show the development of the borehole, the placement of a downhole heater, steps in the coking process, and the completion of two electrode wells, each having an electrode of enlarged effective radius. In FIG. I, showing one embodiment of the invention, a tar sand formation, 1, is shown as the underground formation. Borehole 2 is drilled from surface 3, through overburden 4, through the tar sand formation 1, and at least partially into the underlying formation 5. Suitable casing is set in the overburden and cemented 7 in place, leaving the open borehole (uncased) 8 in tar sand formation 1. Then, as is well known in the petroleum industry, a downhole heating device, exemplified by electric heater 9, is placed in the open borehole 8 of tar sand formation 1. Heating device 9 is connected to and suspended from surface 3 by tool cable 10. Heating device 9 is also connected to a source of power (not shown) on surface 3 by an electrical cable 11, comprising power supply wires, temperature control wires, and other necessary electrical fittings .

The heating device used in the process can be any of a variety of such devices. Although an electric heater is shown in FIG. I, a downhole combustion device, such as a propane burner, can be used to heat the surrounding formation. The type of device used is not critical, as long as a sufficient and controlled supply of heat energy can be applied to the formations surrounding the borehole. The heating device is preferably placed in that portion of the formation where the ultimately-formed electrode is desired. Since these high-temperature devices are subject to stress and corrosion, they usually have a limited life and can be discarded or drilled out in subsequent well completion procedures.

The heating device 9 is controlled at a temperature such that thermal cracking occurs in at least a portion of the hydrocarbon-bearing formation surrounding the heating device. As a consequence of this cracking temperature, nearby formation water is vaporized, and products of thermal cracking, such as light ends, are produced. These vapors and gases can be removed, if necessary, through the borehole. Particles of coke, or thermally cracked carbonaceous material, are produced by these high temperatures, typically greater than 500° F. (260° C.). Porosity is developed in the coke, so that the particles allow the inflow of brine. Thus, the coked portion, containing brine, has improved characteristics as an electrode. FIG. II represents the formation at the end of the coke-producing process. The coked zone 12 is substantially cylindrical in shape, generally following the shape of the heating device. This zone can be considered the raw material for, or the precursor of, the effective electrode of enlarged radius for electrically heating a larger portion of the formation, such as between two electrode wells each having such an electrode.

Some of the variables that enter into the process of the invention include the geology of the hydrocarbon-bearing formation, the thickness of the formation, the temperature and time necessary for cracking the hydrocarbon-bearing portion, and the ultimate effective radius to be formed. The radius of the original borehole, and thus the radius of the heating device, can vary from about 2 in. (5 cm) to about 2 feet (61 cm). The radius of the electrode produced as a result of the preceeding steps can vary from about 2 ft. (61 cm) to about 10 ft. (305 cm). The temperature of the heating device should be at least about 800° F. (426° C.), preferably in the range of 1000°–1500° F. (537°–815° C.), and the time necessary to produce an electrode of the desired radius may vary from about 1 to 12 months.

FIG. III shows a cross-section view of two completed wells, wherein sufficient work has been done on the boreholes to carry out a subsequent heating operation. Tubing strings 13, connected to a proper power source (not shown), are inserted into the boreholes and separated by packing devices from casings 6 and the formation 1. Further, electrical insulating sections 15 are used to insulate the lower metallic portion of each borehole fitting from each casing 6.

Sand screens 16 are inserted, by means well-known in the petroleum industry, in the lower portion of each borehole to provide ingress and egress of the liquids and vapors between formation 1 and borehole 2. Insulating oil 17 is added to the upper portion of each borehole to insulate the charged tubing string 13 from casing 6 and surrounding overburden 4. To provide good electrical contact with formation 1 and to act as a coolant, an electrolyte solution 18, such as brine, can be forced down each inner tubing string and return to the surface through each outer tubing string. Some electrolyte flows through the openings of sand screens 16 and enters coked zones 12. Then, during a subsequent process, as electric energy is applied to the lower portion of each borehole, each coked zone 12 becomes an effective electrode of enlarged radius.

Coked zone 12 has a degree of porosity and permeability related to the original formation. Coke particles (or carbonaceous particles) formed by the in-situ heating of the tar sand are distributed in the pores of the formation, and these particles partially fill the pores. Generally, the pores are connected so that there is a continuous path for the conduction of electricity.

After a proper electrode is prepared in each borehole, electric current can be sent from one electrode through the formation to the other electrode, thus heating the formation.

Coked zones 12 are continuously conductive throughout their volume and are closely connected, electrically, with charged tubing strings 13. Thus, using good electrical practices and technology, when the power source (not shown) is activated on the surface, current flows between the electrode wells and, by resistance heating, heats the tar sand formation. Due to the enlarged effective radius of each electrode well, the current density around each electrode is enough to heat the formation by resistance heating but is, or can be controlled to be, low enough so as not to cause evaporation of the connate water and consequent drying of the formation outside the effective radius at the pressure found in the formation. The voltage and current flow are adjusted to effect the desired gradual increase of temperature of the formation between the wells. Broadly, the current may run from a few hundred to 1000 or more amperes at the voltage drop between the electrode wells. And this voltage drop may run from a few hundred volts to as much as 1000 or more volts.

Electrical heating of the formation continues for a length of time which may be between a few months and 4 years, until sufficient mobility is obtained. There are various methods of determining the temperatures at various points in the formation. If the formation is relatively homogeneous, conventional technology relating the energy input and the rate of heat flow through the formation can be used to estimate temperatures at various points in the formation. Another way is to drill test holes at various locations and measure a temperature profile vertically through the formation. Another way is to apply pressure on one of the boreholes and determine the bitumen flow from the other borehole.

FIG. IV-*a* and IV-*b* are different views of temperature profiles between two electrode wells after a finite time of heating. FIG. 4-*a* shows a cross-section view of such a temperature distribution for wells spaced at a particular distance, and the mid-point is about 110° F. (43° C.). FIG. 4-*b* shows similar information, as a contour or plan view.

FIG. V shows a generalized cross-section view of the temperature distribution between two electrode wells at various times, on a non-specific scale.

When it has been determined that the appropriate minimum temperature has been reached, for example, at the mid-point between the electrode wells, electrical heating is discontinued and preparations are made for the use of an injection fluid.

As is known in enhanced recovery technology, several displacement fluids are available and known. A hydrocarbon solvent, such as a $C_{6-14}$ liquid, can be used to displace the oily bitumen from the formation. And it is known to follow such a solvent wash by a second diplacing fluid, such as water or steam. Hot water, by itself or mixed with a material such as a surfactant or an alkaline material such as sodium hydroxide, can be injected into an injection well to displace the mobile bitumen from the formation into a production well. Steam is another displacement fluid and its use is well known in petroleum technology.

The displacing, or drive, fluid is injected into one of the electrode wells that had previously been used for formation heating. All of the proper technological changes are made in the well to convert it to an injection well. Similarly, the other well is converted to a production well. The drive fluid is injected at a pressure below that which is sufficient to lift the overburden, commonly referred to as "fracturing pressure". This particular pressure is determined by the use of conventional petroleum engineering technology and is typically between about 0.5 and 1 lb. per sq. in. (psi) for each foot of overburden. After the fracturing pressure is determined or estimated, the drive fluid is injected and "drives" the mobile bitumen ahead of it. It is desirable that the temperature of the formation, the drive fluid, and the mobile bitumen be kept as high as possible, within the restraints of the fracturing pressure. Heat energy from the drive fluid is exchanged with the bitumen and/or formation, and these exchanges can be calculated or, by using previously-drilled testholes, temperatures in the drive zone are reported, and the progress of the drive can be monitored.

It is possible that, due to various factors, the formation temperature decreases to where the bitumen is not mobile. It is then desirable to stop the injection of the displacement fluid, restore the wells to the heating situation, and heat the formation to a desired temperature. These changes and interruptions are known in petroleum technology and need not be discussed here.

Bitumen is produced from the production well by conventional techniques. Pumping facilities to remove the fluid bitumen can be used, if necessary, but here again, production techniques are well known and need not be discussed.

Injection and production continue until breakthrough takes place. Breakthrough is considered as that point in the operation where injection fluid establishes a flow path completely between the injection and the production wells. After breakthrough, the amount of bitumen carried with the injection fluid decreases, and further production of bitumen from that well becomes less desirable. At this time, the pattern of injection and production wells can be changed.

Although I have shown only two wells used in the heating and production phases, additional wells can be used, following the steps of the process. By proper patterning of wells throughout the formation, injection and production can be shifted between various wells, and production from a large portion of the formation can be established.

I claim:

1. An electrothermal process for recovering hydrocarbon values from an underground hydrocarbon-bearing formation having at least two separated boreholes penetrating the hydrocarbon-bearing formation, comprising the steps of:

(a) placing a heating device in the first borehole, (b) energizing the device to heat the surrounding formation to a temperature high enough to produce coking of at least a portion of the hydrocarbon-bearing formation, thus forming a coked zone, which, having conductive properties, acts as an electrode, (c) maintaining the temperature of step (b) for a length of time to obtain a coked zone electrode having an effective radius at least twice that of the borehole, (d) repeating steps (a-c) in a second borehole, (e) applying a voltage between the coked zone electrodes of the first and second boreholes, to heat the formation between the boreholes to a temperature at which the hydrocarbon values are mobile, and (f) recovering hydrocarbon values from one of said boreholes.

2. The process of claim 1, wherein:

(a) The temperature of the heating device varies from about 800° F. (426° C.) to about 1500° F. (815° C.), (b) the time for maintaining the temperature of the heating device is from about one to about twelve months, (c) an electrolyte solution is introduced to the coked zone to assist in the formation of an effective electrode of enlarged radius, said radius being larger than the radius of the borehole, and (d) voltage is applied between the electrodes of the separated boreholes until the mid-point temperature of the formation is from about 130° F. (54° C.) to about 230° F. (110° C.).

* * * * *